United States Patent [19]

Lynch, Jr.

[11] 4,156,952

[45] Jun. 5, 1979

[54] CARPET SOIL EXTRACTOR HAVING A POWERED BRUSH

[75] Inventor: Patrick E. Lynch, Jr., Phoenix, Ariz.

[73] Assignee: Chemko Industries, Inc., Phoenix, Ariz.

[21] Appl. No.: 839,301

[22] Filed: Oct. 4, 1977

[51] Int. Cl.[2] ..... A47L 7/00

[52] U.S. Cl. ..... 15/320; 15/321; 15/322; 15/381

[58] Field of Search ..... 15/320, 321, 322, 380, 15/381

[56] References Cited

U.S. PATENT DOCUMENTS

| | | | |
|---|---|---|---|
| 2,635,278 | 4/1953 | Belknap | 15/381 X |
| 3,840,935 | 10/1974 | Fitzgerald et al. | 15/322 |
| 3,883,301 | 5/1975 | Emrick et al. | 15/321 X |
| 3,959,844 | 6/1976 | Cyphert | 15/320 |
| 4,014,067 | 3/1977 | Bates | 15/320 |

*Primary Examiner*—Christopher K. Moore

*Attorney, Agent, or Firm*—Cahill, Sutton & Thomas

[57] ABSTRACT

A self contained compact carpet soil extractor includes a vacuum tube for singularly supporting a vacuum head, nozzles through which the cleaning solution is dispensed, a pivotally mounted powered brush and motor means for driving the brush; additionally, the source of vacuum, a supply of cleaning solution under pressure and a waste tank are directly or indirectly suspended from the vacuum tube. One variant includes means for supporting a quantity of the cleaning solution upon the vacuum tube and a further variant relies upon external sources to provide vacuum and cleaning solution. Support upon the carpet for the extractor is provided by the mouth of the vacuum head, the brush and a curved spring skid; the force exerted by the brush and the depth to which the brush extends into the carpet nap is primarily a function of the bristle length with respect to the plane defined by the vacuum head mouth and the skid.

29 Claims, 13 Drawing Figures

77
85
84
76
87
88
75
70
71
60

A
B
C
3
5
74
75
70
80
81
71
62
15
72
63
64
60
16
25
27
29
26
28
67
11
21
22
13
12
56
53
19
18
14
20
38
39
51
50
42
52
49
40
35
31
33
47
48
54
30
41
34
32
44
43
44
58
66
65
61

115

CARPET SOIL EXTRACTOR HAVING A POWERED BRUSH

The present invention relates to carpet cleaning machinery and, more particularly, to carpet soil extractors having pivotally mounted powered brushes.

It is well known that carpets which are cleaned regularly not only have a better appearance but also wear significantly longer than carpets which are permitted to carry traffic while soiled. Much of the particulate matter which forms a part of the dirt within a carpet is abrasive in nature. Continual traffic upon a dirty carpet tends to cause the abrasive particulate matter to abrade the pile and backing of the carpet. Furthermore, all of the dirt is continually forced deeper and deeper into the carpet.

Although it is possible to pick up a carpet and transport it to a facility for cleaning, many carpets cannot, as a practical matter, be removed from their location. Wall to wall carpet installations are somewhat permanent in nature also and it is not contemplated that such a carpet is to be removed for cleaning or other purposes. Accordingly, it is particularly advantageous if the carpet could be cleaned in situ rather than removed to a distant point for cleaning.

Many cleaning methods apply water to the carpet being cleaned. Unless great care is taken, the water can create substantial problems. Among these problems are: The backing material of many carpets shrinks or decomposes if allowed to remain wet; underlying surfaces, such as oak flooring, are ruined by water; if the dye is not waterfast, it will run or fade; all normal traffic must be rerouted for a substantial period of time since a wet carpet should not be walked upon; and, all furniture must be removed from the entire carpet surface while the carpet is drying.

Normally, water or a solution of water and cleaning agent is ejected through nozzles to strike the carpet with a substantial force. The bombardnment of the carpet by the water tends to dislodge dirt entrained within the nap and, when a chemical solution is employed, it tends to aid the severing of particulate matter adhering to strands of the carpet. A chemical solution is sometimes employed which will dissolve or liquify certain particulate matter and thereby aid in extraction. Aside from the dislodgement by the impact force of the discharged water and the chemical action of a cleaning solution, agitation means, such as a brush, is often employed to encourage mixing of the particulate matter with the ejected water or cleaning solution.

Accordingly, it is well known to distribute a solution of water and cleaning agent on the surface of a carpet, agitate the mixture into the pile of the carpet to loosen the retained particulate matter by the scrubbing action of a brush and then vacuum the mixture of particulate matter and solution from the carpet. Thereby, the particulate matter is removed and the carpet is not left in a soaked state to dry by evaporation.

Commonly, when a brush is employed to agitate and scrub the pile of a carpet, it is a rotary brush. Apparatus employing such brushes are disclosed and described in U.S. Pat. No. 2,726,807, which illustrates a rotary brush rotating about a vertical axis. U.S. Pat. Nos. 2,910,720, 3,392,418, 3,402,420, 3,699,607 and 3,871,051 teach the use of rotary brushes rotating about a horizontal axis. While all of these brushes do scrub the pile of a carpet, certain inherent difficulties are encountered. First, the scrubbing action occurs in only one direction whereby the pile is not agitated back and forth or side to side; necessarily, the brush bristles cannot come into contact with the complete surface of the strands forming the pile of the carpet. Second, the scrubbing pressure exerted by the brushes upon the pile is a function of the rotational speed of the brush and downward bias exerted upon the brush; because of the mechanical coupling of a rotary brush, adjustments of the bias are necessarily mechanically difficult and changes in rotational speed involve complex and expensive mechanisms because of inherent high torque requirements. Third, rotary brushes are expensive.

To avoid the problems of rotary brushes, other brush agitation devices have been developed which are represented by U.S. Pat. No. 3,117,337. It discloses a sponge rubber scrubbing pad extending transverse to the direction of travel of the carpet cleaning mechanism. The scrubbing action is performed by movement of the carpet cleaning head across the carpet and no independent movement of the pad is employed. U.S. Pat. No. 3,273,193, teaches a brush oriented transverse to the direction of travel of the cleaning head and the brush is rectilinearly reciprocally translatable by complex sliding sleeves in the direction of travel of the cleaning unit. U.S. Pat. No. 3,602,933 teaches the use of a brush oriented transverse to the direction of travel of the cleaning head, which brush is rigidly mounted upon a wheel supported chassis; the pressure exerted by the bristles upon the pile is a function of the bristle length and the pile height.

However, an application for U.S. Pat., Ser. No. 787,932, now U.S. Pat. No. 4,136,420 and U.S. Pat. Nos. 3,959,844 and 4,019,218, and assigned to the present assignee, describe pivotally mounted reciprocating brushes mounted transverse to the direction of travel and which scrub the complete surfaces of the strands forming the nap of the carpet. Moreover, the bias applied by the brushes is variable to comport with the length and density of the nap.

The carpet soil extractors earlier developed under the direction of the present assignee are intended primarily for heavy duty industrial use. However, a need has continued to exist for lighter duty but effective carpet soil extractors which are also substantially less expensive. The carpet soil extractor described herein was developed to meet these demands while retaining the cleaning capability of the industrially oriented carpet soil extractors.

The carpet soil extractor described herein includes a single rigid vacuum tube upon which all of the operative elements are mounted. A vacuum head extends from the lower end of the vacuum tube. The solution ejecting nozzles are mounted in proximity to the junction between the vacuum tube and vacuum head. Pivotal support for a reciprocating brush is also provided at the junction of the vacuum head and vacuum tube. A motor is secured to the vacuum tube in general alignment therewith for supplying power to a linkage system supported brush through a rotating offset pin driving a link pivotally connected to the linkage system. The casing of the motor serves as a structural element to which a plate supporting a curved spring skid is attached. A pulley driven pump is also attached to the plate and supplies a flow of cleaning solution from a collapsible bag disposed within a vacuum tube mounted container. A vacuum pump, attached to the container, developes a vacuum within the container to draw the dirty solution from the carpet through the vacuum head.

It is therefore a primary object of the present invention to provide a carpet soil extractor having a reciprocating brush which scrubs the pile of the carpet.

Another object of the present invention is to provide a carpet soil extractor which automatically agitates the pile of the carpet to loosen and raise the dirt entrained therein upon a single pass across the carpet.

Still another object of the present invention is to provide a carpet soil extractor having all operative components mounted upon a common element.

Yet another object of the present invention is to provide a carpet soil extractor supported upon a carpet solely by the mouth of a vacuum head, a reciprocating brush and a spring skid.

A further object of the present invention is to provide a carpet soil extractor of mechanically simple construction without compromising performance.

A still further object of the present invention is to provide an inexpensive but effective carpet soil extractor.

A yet further object of the present invention is to provide a carpet soil extractor having a means for varying the pressure exerted through a reciprocating brush by manually varying the tilt angle of the carpet soil extractor.

A yet further object of the present invention is to provide a carpet soil extractor which does not need support wheels for operation across a carpet.

These and other objects of the present invention will become apparent to those skilled in the art as the description thereof proceeds.

The present invention may be described with greater specificity and clarity with reference to the following drawings, in which.

Figures 1, 2:
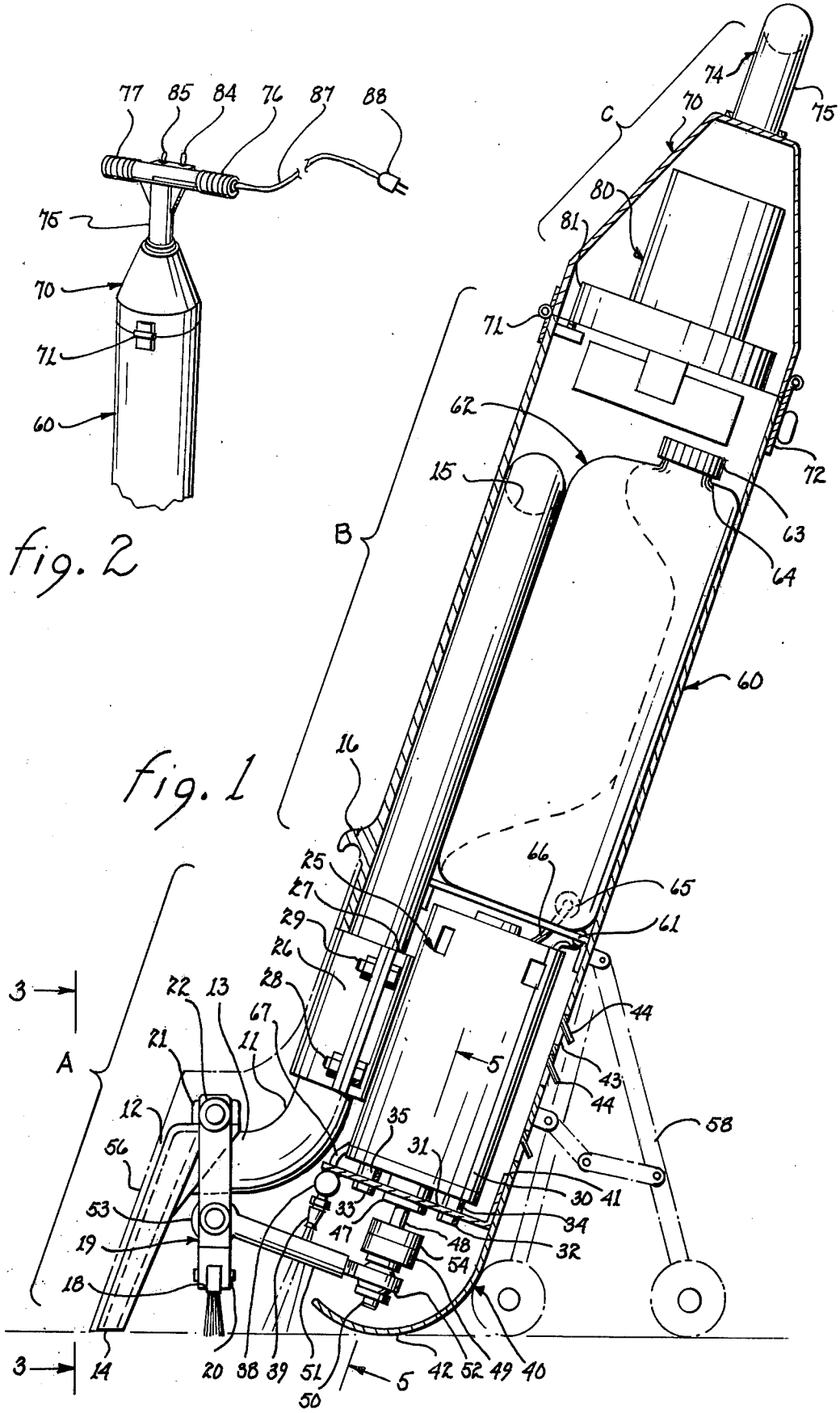
FIG. 1 is a cross-sectional view of a carpet soil extractor.
FIG. 2 is a partial perspective view of the top end of the carpet soil extractor shown in FIG. 1.
Figure 11:
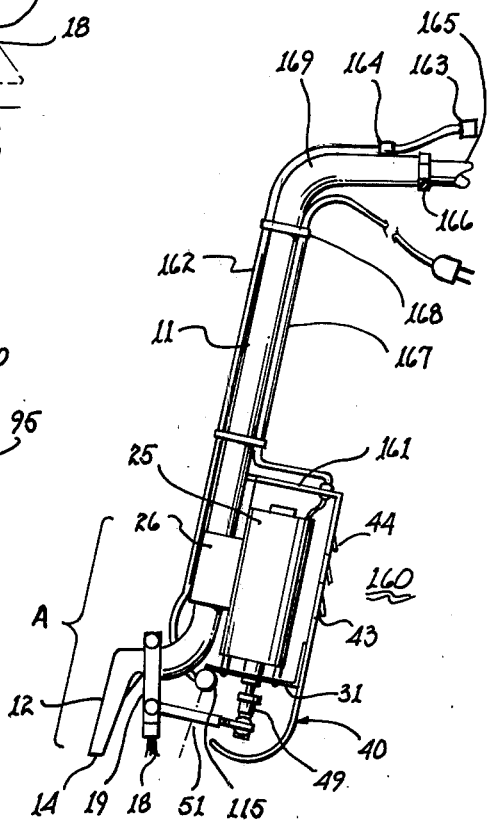
Figure 5:
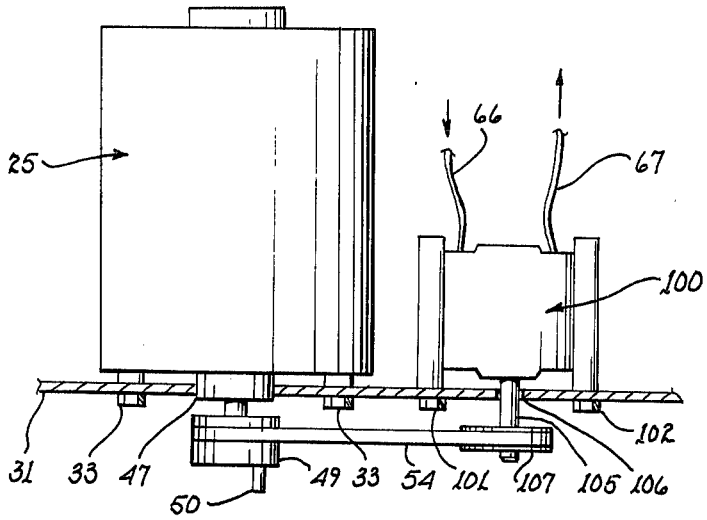
FIG. 5 is a cross-sectional view taken along lines 5—5, as shown in FIG. 1.
Figure 8:
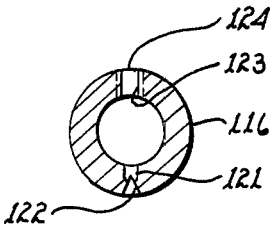
Figure 6:
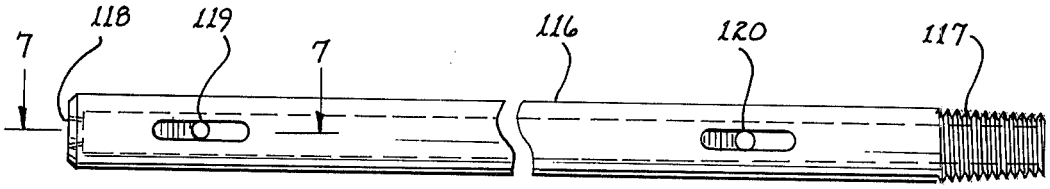
Figure 7:
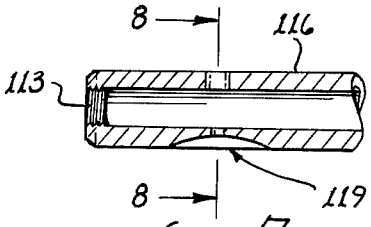
Figure 5A:
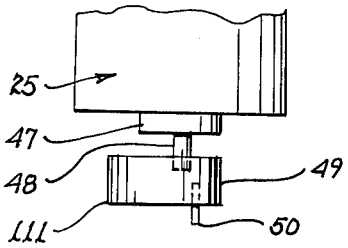
Figure 5B:
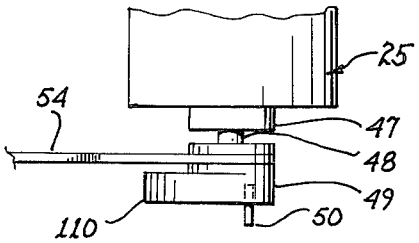
Figure 9:
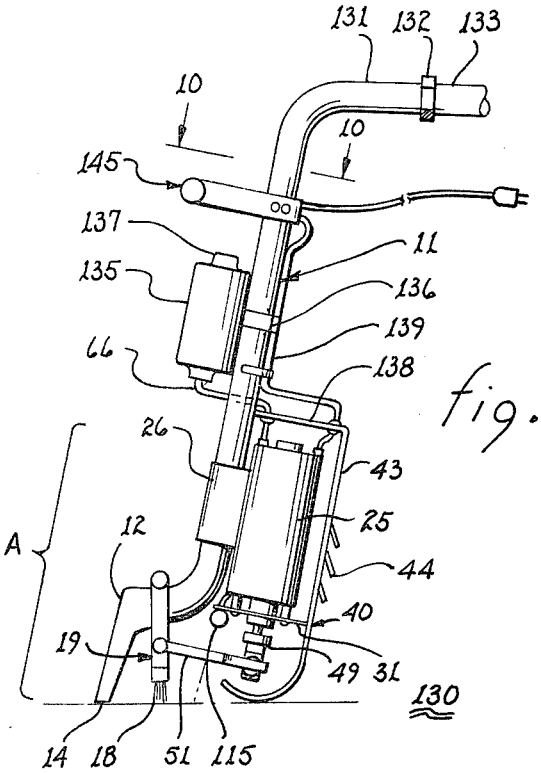
Figure 10:
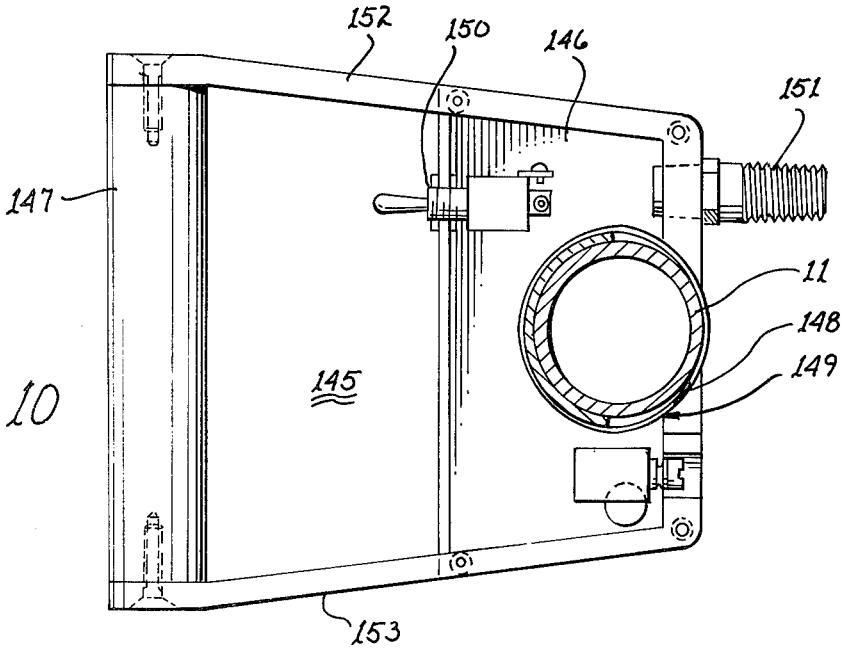

FIGS. 5*a* and 5*b* are partial views illustrating variations of the motor mounted cam;

FIG. 6 illustrates the nozzles disposed within a solution dispensing tube;

FIG. 7 is a cross-sectional view taken along lines 7—7, as shown in FIG. 6;

FIG. 8 is a cross-sectional view taken along lines 8—8, as shown in FIG. 7;

FIG. 9 illustrates a first variant of the carpet soil extractor shown in FIG. 1;

FIG. 10 is a top view of a bail taken along lines 10—10, as shown in FIG. 9; and FIG. 11 illustrates a second variant of the carpet soil extractor shown in FIG. 1.

A self contained carpet soil extractor is illustrated in FIGS. 1 and 2; by the use of the term "self contained" it is intended to mean that only a source of electrical power is required in order for the carpet soil extractor to operate in the manner intended.

Carpet soil extractor 10 is functionall segregable into three sections. Section A includes the mechanically operative elements. Section B includes the source of cleaning solution and the receptacle for the vacuumed waste water. Section C includes the means for generating a source of vacuum.

For purposes of structural integrity, robustness and manufacturing simplicity, vacuum tube 11 serves not only the function of drawing the waste water from the carpet being cleaned but also as the focal point to which the primary components are attached. Vacuum head 12, if manufactured as an independent element, is attached to lower end 13 of the vacuum tube by welding, braising or the like; alternatively, the vacuum head and the vacuum tube may be developed as a single unitary element. Mouth 14 of the vacuum head is an elongated slot which may be covered with a powder coating of epoxy or epoxy-like material to permit it to slide smoothly across a carpet with minimum friction.

A brush 18 is detachably attached to the lower ends of the linkage system 19 by means of removable bolts or pins 20. Thereby, the brush can be readily replaced if worn or the brush can be substituted for one having a bristle length commensurate with the surface being cleaned. Linkage system 19 is pivotally secured to the upper part of vacuum head 12 by a pillow block 21, or the like. Alternatively, a journal may be machined through the vacuum head to rotatably support shaft 22 from which the linkage system 19 depends.

An electric motor 25 is attached to vacuum tube 11 by a flanged U-shaped clamp 26 which in combination with base 27 welded to the motor chassis encircles the vacuum tube. Nut and bolt combinations 28 and 29 secure the base to the clamp. Chassis 30 of motor 25 supports a plate 31 by means of bolts 32 and 33 threadedly engaging threaded bosses 34 and 35 extending from the chassis.

A plenum chamber 38 is welded or otherwise attached in proximity to one end of plate 31. This plenum chamber supports a plurality of nozzles, of which nozzle 39 is illustrated in FIG. 1.

A spring skid 40 is welded or otherwise secured to flange 41 of plate 31. At least the skid portion 42 of the spring skid is of spring steel, or the like, to be resiliently compliable with and accommodate a downward force exerted by an operator upon the carpet soil extractor. For low friction and good wear, the bottom surface may be covered with an epoxy powder coating. The upper portion 43 of the spring skid includes a plurality of louvers 44 to provide a cooling air flow into the compartment housing motor 25.

Motor 25 includes a boss 47 containing a bearing for output shaft 48 and which boss, tightly, if not sealingly, mates with a corresponding aperture within plate 31. Output shaft 48 extends downwardly from boss 47 and supports a cam 49. A pin 50 extends downwardly from cam 49 along an axis offset from the axis of rotation of the cam. One end of a link 51 is swivel mounted upon pin 50 through swivel 52. The other end of the link is attached to linkage system 19 through a swivel bearing 53. From the above description, it may be understood that upon actuation of motor 25, offset pin 50 will produce a reciprocal translation of link 51 resulting in reciprocal pivotal movement of linkage system 19 and brush 18 about the pivot point represented by shaft 22.

Cam 49 includes a V groove for supporting a belt 54. This belt drives a pump (not illustrated in FIG. 1) for pumping the cleaning solution used by the carpet soil extractor.

A pivotally mounted wheel and carriage assembly 58 may be attached to upper portion 43 of spring skid 40.

The wheel and carriage assembly, when located in the extended position, provides support for carpet soil extractor 10 to maintain it in the upright position when the carpet soil extractor is not in use. When the carpet soil extractor is in use, the wheel and carriage assembly is folded adjacent upper portion 43, as illustrated in phantom lines, to preclude it from interfering with the operation of the carpet soil extractor.

Section B includes a cylindrical container 60 welded or otherwise attached to vacuum tube 11. It may be noted that the vacuum tube terminates within the container at outlet 15. Bottom 61 of the container is sealingly mated with the vacuum tube and with the sides of the container to establish a water tight compartment. A collapsible bag 62 is disposed within the container adjacent the vacuum tube. A cap 63 seals inlet 64 of the collapsible bag, which inlet is used to refill the bag. At the bottom of the collapsible bag, an outlet 65 is in fluid communication with one end of a length of tubing 66. The other end of the tubing, after first sealingly penetrating bottom 61 of the container, is in communication with the inlet to the pump (not illustrated) driven by motor 25. The outlet of the pump is connected to a further length of tubing 67, which tubing feeds plenum chamber 39.

Section C of carpet soil extractor 10 includes a conical shroud 70 pivotally attached to the upper end of container 60 by hinge 71. A latch mechanism 72 secures the shroud in place. Seals and/or internal flanges are employed to maintain the junction between container 60 and conical shroud 70 air tight. A T-handle 74, including an upright section 75 and hand grips 76 and 77, extends from the apex of the conical shroud. An electrically operated vacuum motor 80 is disposed within conical shroud 70. The exhaust for the vacuum motor may be through handle 74 or through openings disposed within the conical shroud. It is to be understood that base 81 of the vacuum motor is sealingly attached to the lower perimeter of the conical shroud in order to create a vacuum within container 60.

T-handle 74 includes one or more switches 84, 85 for controlling the operation of motor 25 and vacuum motor 80. In addition, speed regulating controls may also be incorporated within the handle along with fluid level indicators and the like. An electrical cord 87 and plug 88 extend from T-handle 74 for connection to a source of electric power.

The operation of carpet soil extractor 10 may be described as follows. After collapsible bag 62 has been filled with a cleaning solution, switches 84 and 85 are actuated to energize motor 25 and vacuum motor 80. Energization of motor 25 will produce rotation of shaft 48 resulting in reciprocal translation of link 51 and commensurate reciprocal pivotal movement of brush 18 through linkage assembly 19. Thereby, the carpet to be cleaned will be scrubbed by brush 18. Simultaneously, belt 54 will drive a pump (not illustrated) to produce a flow of cleaning solution from collapsible bag 62 through tubing 66, through the pump, through tubing 67 and into plenum chamber 38 wherefrom it is dispensed through the nozzles (of which nozzle 39 is illustrated). Thereby, a cleaning solution will be sprayed upon and impregnate the carpet with some force. On energization of vacuum motor 80, a vacuum will be developed within vacuum tube 11 and vacuum head 12. The vacuum present at mouth 14 will draw waste water, including particulate matter, the cleaning solution and the particulate matter suspended within the cleaning solution, from the carpet. The waste water will flow upwardly through vacuum head 12, vacuum tube 11 and be ejected therefrom through outlet 15 into container 60. As the cleaning solution is dispensed from collapsible bag 62, the bag will tend to collapse, as indicated by the dashed line. Simultaneously, the level of waste water within container 60 vacuumed from the carpet will rise. It will be appreciated that the quantity picked up by the vacuum head will be equal to or less than that dispensed from the collection bag. Thereby, the total internal volume of container 60 need be no greater than that of the collapsible bag since the latter will collapse to accommodate the inflowing solution.

Since the skid portion of spring skid 40 is resiliently flexible, the operator, either by tilting the carpet soil extractor toward him while pulling on it or by bearing down on the carpet soil extractor can increase the scrubbing force exerted by the brush. Conversely, the scrubbing force can also be decreased by opposite action.

After all of the cleaning solution within the collection bag has been dispensed, container 60 will contain the waste water picked up from the carpet. Disposal of the waste water is readily accomplished as follows. By unlatching latch 72 and tilting conical shroud 70 about hinge 71, the top of container 60 is opened. By tilting the carpet soil extractor, the dirtied solution can be poured into a sink, bucket or the like. A finger grip 16 in proximity to the bottom of the container will aid in the handling of the carpet soil extractor. Thereafter, collapsible bag 62 can be refilled through inlet 34 after cap 63 has been removed.

A shroud 56 is disposed about section A and cooperates with spring skid 40 to enclose the operative elements and prevent unwanted splashing of the sprayed cleaning solution. Additionally, means are provided to seal the edges of plate 31 to the shroud and about vacuum tube 11 to minimize the possibility of flow or seepage of liquid in proximity to or into electric motor 25.

Figure 3:
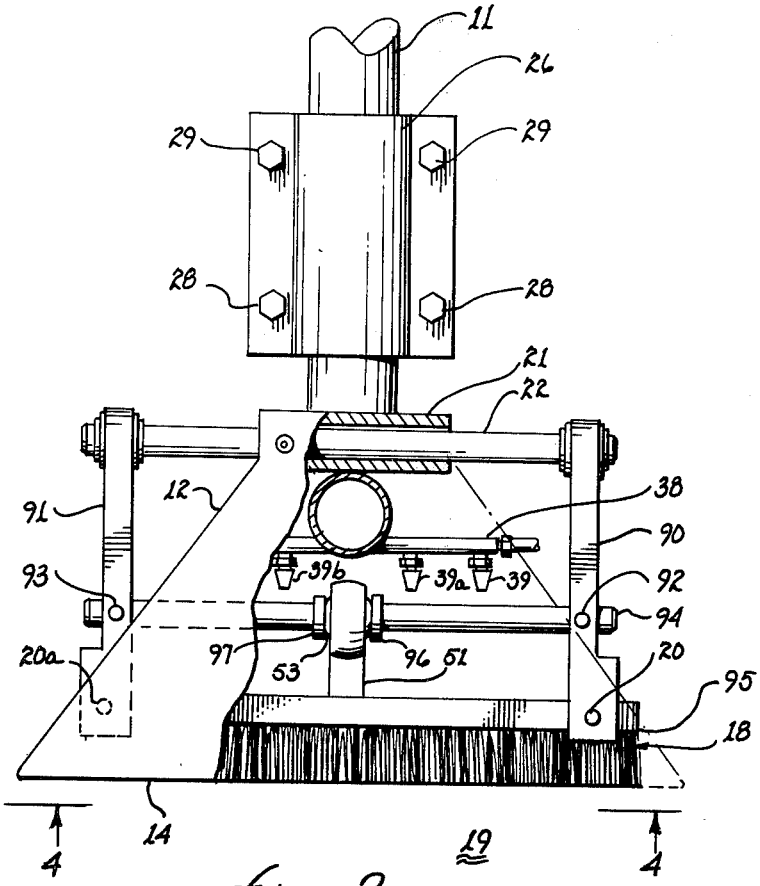
FIG. 3 is a frontal view of the operative elements taken along lines 3—3, as shown in FIG. 1.
Figure 4:
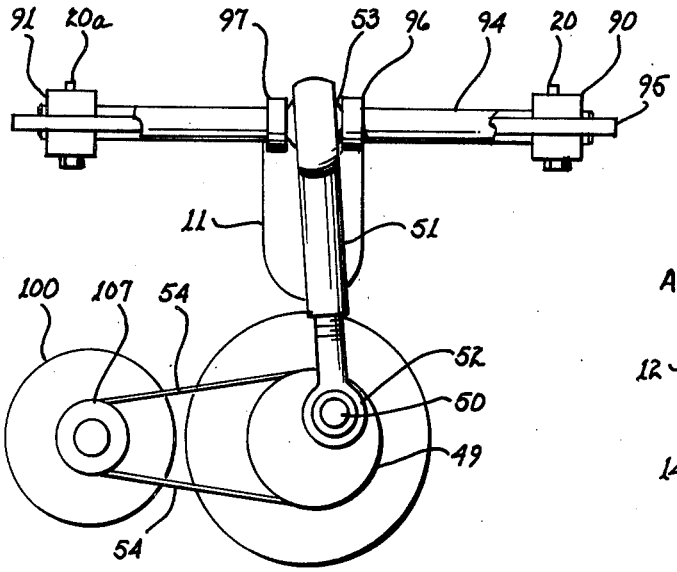
FIG. 4 is a bottom view of the operative elements taken along lines 4—4, as shown in FIG. 3.

Referring now to FIGS. 3 and 4, linkage system 19 will be described in further detail. Shaft 22, secured by pillow block 21, or journalled within a passageway extending through the upper part of vacuum head 12, pivotally supports a pair of depending links 90 and 91. These links are rigidly attached by bolt or pin means 92 and 93 to shaft 94. The lower ends of links 90 and 91 support base 95 of brush 18 through pins 20 and **20*a*. Swivel 53, attached to the extremity of link 51, is maintained at the center of shaft 94 by snap rings 96, 97** or the like.

As may be noted in FIG. 3, nozzles 39, **39*a* and 39*b* extend downwardly from plenum chamber 38 and provide a fan spray pattern oriented parallel to mouth 14 of vacuum head 12. It may be noted that the spray patterns from nozzles 39*a* and 39*b* do not impinge upon link 51 but cross beneath it. Thereby, the force of the spray is not diminished through reflection off the link. Additionally, the spray will thereby not be deflected upwardly against plate 31**.

Referring jointly to FIGS. 4 and 5, the structure and operation of cleaning solution pump 100 will be described. The pump is bolted to the upper surface of plate 31 by bolts 101 and 102 extending through the plate into threaded engagement with the chassis of the pump. Shaft 105 extends downwardly from the pump through aperture 106 in the plate. A pully 107 is attached to the end of the shaft for receiving belt 54. Tubing 66, extending from the collapsible bag, conveys the inflowing cleaning solution; and, tubing 67 conveys the cleaning solution under pressure from the pump to the plenum chamber. In operation, on energization of motor 25, cam 49 will rotate and drive pulley 107 through belt 54. Rotation of pulley 107 actuates pump 100 to produce the requisite flow of cleaning solution through tubing 66 and 67.

Because pin 50 extends from cam 49 off center of the axis of rotation of the cam, an imbalance, results, which imbalance produces a vibration attendant the operation of the carpet soil extractor. Such imbalance, and the attendant vibration, can be eliminated by forming cam 49 with a lobe 110 diametrically offset from pin 50, as illustrated in FIG. 5*a*. It may also be noted that the position of lobe 110 does not interfere with the groove driving belt 54. For embodiments of the carpet soil extractor which incorporate an external source of cleaning solution under pressure and therefore do not require a pump, the cam illustrated in FIG. 5*b* may be utilized. Herein, a lobe 110 is diametrically offset from pin 50 to produce a balance about the axis of rotation of cam 49; however, the cam does not include a groove as a belt is not driven by the cam.

Since one of the purposes of the present invention is that of producing a low cost yet very effective carpet soil extractor, various efforts have been undertaken to minimize the cost of the parts themselves and the manufacturing costs. FIGS. 6, 7 and 8 illustrate a nozzle assembly 115 which may be incorporated in place of plenum chamber 38 and nozzles 39, etc. The nozzle assembly includes a tube 116 having an externally threaded end 117 for threaded engagement with the end of tubing 67. The other end of tube 116 is closed by a plug 118 or similar device. Nozzles 119 and 120 are developed by drilling from the top of the tube through one side of the tube but terminating short of the outer surface of the diametrically opposed side of the tube. Thereby, a circular cavity 121 having a cone-shaped bottom is developed in the bottom of tube 116. An arcuate V-shaped groove 122 is formed from the exterior surface of the bottom of the tube in alignment with the longitudinal axis of the tube and penetrating but not obliterating the cone-shaped bottom of cavity 21. Thereafter, hole 123 is sealed with a plug 124.

The spray pattern produced by each of nozzles 119 and 120 is fan-like with its major axis in alignment with the longitudinal axis of tube 116. It may be noted that only two nozzles need be used and that the spray pattern from these two nozzles, whether or not they partially overlap one another, will clear link 51. Thus, the full force and effect of the spray will directly strike the carpet being cleaned.

A first variant 130 of carpet soil extractor 10 is illustrated in FIG. 9. In this variant, an external source of vacuum is employed. To introduce the source of vacuum to vacuum tube 11, and ultimately to mouth 14 of vacuum head 12, a handle 131 extends from the upper extremity of vacuum tube 11. This handle includes a fitting 132 at its extremity, or the fitting may be disposed at any other convenient location, for attaching a vacuum hose 132 in fluid communication with a source of vacuum. A container 135 for housing the cleaning solution is attached to vacuum tube 11 by strap 136 or similar attachment device. Container 135 includes a capped inlet 137 for refilling the container. Tubing 66 extends from the bottom of container 135 through cover 138 to pump 100 mounted upon plate 31 (see FIG. 5). The outflow from pump 100 is conveyed through tubing 67 to nozzle assembly 115 (see FIGS. 6–8). Motor 25, secured to vacuum tube 11 by clamp 26 and receiving power through electrical conductor 139, drives brush 18 via cam 49, link 51 and linkage system 19. Skid plate 40 includes louvers 44 disposed in upper section 43 to provide cooling air for the motor. Although not illustrated, a shroud mates with spring skid 40 and cover 138 to enclose all of section A of variant 130 for both aesthetic purposes and to minimize splashing of sprayed cleaning solution onto adjacent areas. It may be noted that container 135 is diametrically opposed to motor 25 which tends to balance the carpet soil extractor and allow it to stand supported only by the vacuum head and the spring skid. The controls for operation of the motor and regulation of the flow through the vacuum tube may be achieved through hand operated controls located upon or in proximity to handle 131. Alternatively, they may be located upon bail 145.

Referring jointly to FIGS. 9 and 10, bail 145 will be described. The purpose of bail 145 is two-fold; first, it serves as a console for controlls to regulate the operation of the carpet soil extractor; second, it serves as a second handle for manipulating the carpet soil extractor across a carpeted surface. The bail includes an apertured body 146 and a handle 147. Vacuum tube 11 is penetrably received within aperture 148 in body 146 and is secured thereto by means of a hose clamp 149, or the like. By use of such a clamp, the height of the bail with respect to the vacuum tube may be varied and its rotational position about the vacuum tube with respect to handle 131 may be altered to suit left and right handed operators as well and any special perferences of the operators.

A toggle switch 150 is mounted upon body 146 and serves an an on-off switch for supplying electrical power through conductor 139 to motor 25; incoming electrical power is obtained through electrical conductor 151. If preferred, the toggle switch may be replaced by a rocker switch, a deadman's switch, or the like. Handle 147 is somewhat displaced from body 146 and is supported by arms 152 and 153 extending from the body. Although not illustrated, bail 145 may include switches or other regulating devices for controlling the operation of the source of vacuum.

A second variant 160 of carpet soil extractor is illustrated in FIG. 11. In this variant, both the source of vacuum and the source of cleaning solution under pressure are provided by external equipment. Motor 25 is secured to vacuum tube 11 by clamp 26. Plate 31, attached to motor 25, supports spring skid 40, the upper section 43 of which is louvered with louvers 44 to provide cooling air for the motor. As described above, cam 49 reciprocally translates link 51 to reciprocally pivot linkage system 19 resulting in reciprocal motion of brush 18 through an arc. The cleaning solution under pressure is dispensed from nozzle assembly 115. A shroud, not illustrated, envelopes all of section A of variant 160 to provide protection for motor 25 and to prevent unwanted splashing of the cleaning solution. A cover 161, cooperates with the upper portion 43 and the shroud to complete the enclosure for the motor.

Cleaning solution is conveyed to nozzle assembly 115 through hose 160, which hose is attached to a source of cleaning solution under pressure through fitting 163. As illustrated, clamp 164 or similar devices may be employed to secure hose 160 against vacuum tube 11. The vacuum tube is attached to a vacuum hose 165 through a fitting 166 to establish a source of vacuum at mouth 14 of vacuum head 12. Electrical power to motor 25 is provided through electrical conductor 167, which conductor may be routed adjacent vacuum tube 11 by clamps 168.

Controls for the operation of motor 25, regulation of the vacuum within vacuum tube 11 and the flow of cleaning solution may be disposed upon handle 169 extending from the vacuum tube or at a remote source. Additionally, bail 145 illustrated in FIG. 10, may be attached to variant 160.

While the principles of the invention have now been made clear in an illustrative embodiment, there will be immediately obvious to those skilled in the art many modifications of structure, arrangements, proportions, elements, materials, and components, used in the practice of the invention which are particularly adapted for specific environments and operating requirements without departing from those principles.

I claim:

1. A manually propelled carpet soil extractor for cleaning carpets and operable in conjunction with a source of vacuum and a source of cleaning solution under pressure, said carpet soil extractor comprising in combination:

a. a vacuum tube connected to said source of vacuum, said vacuum tube having a lower end for drawing waste water from the carpet;

b. a vacuum head attached to the lower end of said vacuum tube for vacuuming the carpet, said vacuum head including a mouth;

c. a brush for scrubbing the carpet, said brush being in general longitudinal alignment with the longitudinal axis of said mouth;

d. a pivotally depending linkage assembly suspended from the lower end of said vacuum tube for supporting said brush and imparting a reciprocating arcuate motion to said brush;

e. a motor for reciprocally pivoting said linkage assembly, said motor including a rotating output shaft, a casing and means for attaching said casing to said vacuum tube;

f. means for translating the rotary motion of said output shaft into reciprocating pivotal motion of said linkage assembly;

g. a curved spring skid for supporting, in conjunction with said vacuum head, said carpet soil extractor upon the carpet;

h. a plate secured to said casing of said motor for supporting said spring skid; and i. a nozzle assembly secured to said plate and in fluid communication with said source of cleaning fluid under pressure for spraying the carpet with cleaning solution.

2. The carpet soil extractor as set forth in claim 1 wherein said translating means comprises a cam attached to said output shaft and having an offset pin extending therefrom and a link interconnecting said pin and said linkage assembly.

3. The carpet soil extractor as set forth in claim 2 wherein said linkage assembly includes means for detachably attaching said brush.

4. The carpet soil extractor as set forth in claim 3 wherein said spring skid includes an upper portion for shielding said motor.

5. The carpet soil extractor as set forth in claim 4 wherein said vacuum tube and said vacuum head comprise a unitary structure.

6. The carpet soil extractor as set forth in claim 4 including a bail secured to said vacuum tube for aiding in movement of said carpet soil extractor across the carpet.

7. The carpet soil extractor as set forth in claim 2 wherein said nozzle assembly includes a tube and at least one orifice disposed in the bottom wall of said tube for discharging the cleaning solution.

8. The carpet soil extractor as set forth in claim 7 wherein each said orifice comprises a circular cavity having a cone-shaped lower end and an arcuate groove extending from the outer surface of the bottom wall into said cone-shaped lower end.

9. The carpet soil extractor as set forth in claim 1 wherein said source of cleaning solution under pressure comprises in combination:

a. a container for housing the cleaning solution and means for securing said container to said vacuum tube;

b. a pump secured to said plate for pumping the cleaning solution;

c. means for transmitting power from said motor to said pump;

d. tubing means for conveying the cleaning solution from said container to said pump; and e. further tubing means for conveying the cleaning solution from said pump to said nozzle assembly;

whereby, said carpet soil extractor supports said source of cleaning fluid under pressure.

10. The carpet soil extractor as set forth in claim 9 wherein said translating means comprises a cam attached to said output shaft and having an offset pin extending therefrom and a link interconnecting said pin and said linkage assembly.

11. The carpet soil extractor as set forth in claim 10 wherein said transmitting means includes pulley drive means for interconnecting said cam with said pump.

12. The carpet soil extractor as set forth in claim 11 wherein said linkage assembly includes means for detachably attaching said brush.

13. The carpet soil extractor as set forth in claim 12 wherein said spring skid includes an upper portion for shielding said motor.

14. The carpet soil extractor as set forth in claim 12 wherein said vacuum tube and said vacuum head comprise a unitary structure.

15. The carpet soil extractor as set forth in claim 12 including a bail secured to said vacuum tube for aiding in movement of said carpet soil extractor across the carpet.

16. The carpet soil extractor as set forth in claim 10 wherein said nozzle assembly includes a tube and at least one orifice disposed in the bottom wall of said tube for discharging the cleaning solution.

17. The carpet soil extractor as set forth in claim 16 wherein each said orifice comprises a circular cavity having a cone-shaped lower end and an arcuate groove extending from the outer surface of the bottom wall into said cone-shaped lower end.

18. The carpet soil extractor as set forth in claim 1 including:

a. a container attached to said vacuum tube for housing the cleaning solution and receiving the waste water;

b. said source of cleaning solution comprising:

i. a collapsible bag disposed within said container for housing the cleaning solution;

ii. pump means secured to said plate for conveying the cleaning solution from said collapsible bag to said nozzle assembly under pressure;

c. said source of vacuum comprising a vacuum motor in fluid communication with said container for establishing a low pressure environment within said container; and d. an outlet disposed in said vacuum tube within said container for discharging the waste water from said vacuum tube into said container;

whereby, said cource of vacuum and said source of cleaning solution under pressure are self contained within said carpet soil extractor.

19. The carpet soil extractor as set forth in claim 18 wherein said translating means comprises a cam attached to said output shaft and having an offset pin extending therefrom and a link interconnecting said pin and said linkage assembly.

20. The carpet soil extractor as set forth in claim 19 wherein said transmitting means includes pulley drive means for interconnecting said cam with said pump.

21. The carpet soil extractor as set forth in claim 20 wherein said linkage assembly includes means for detachably attaching said brush.

22. The carpet soil extractor as set forth in claim 21 wherein said spring skid includes an upper portion for shielding said motor.

23. The carpet soil extractor as set forth in claim 21 wherein said vacuum tube and said vacuum head comprise a unitary structure.

24. The carpet soil extractor as set forth in claim 21 wherein said container includes an openable top for emptying the waste water from said container and for refilling said collapsible bag with cleaning solution.

25. The carpet soil extractor as set forth in claim 24 wherein said vacuum motor is disposed within said top.

26. The carpet soil extractor as set forth in claim 25 including a handle extending from said top for aiding in movement of said carpet soil extractor across the carpet.

27. The carpet soil extractor as set forth in claim 26 wherein said container is cylindrical and wherein said top is a conical shroud.

28. The carpet soil extractor as set forth in claim 19 wherein said nozzle assembly icludes a tube and at least one orifice disposed in the bottom wall of said tube for discharging the cleaning solution.

29. The carpet soil extractor as set forth in claim 28 wherein each said orifice comprises a circular cavity having a cone-shaped lower end and an arcuate groove extending from the outer surface of the bottom wall into said cone-shaped lower end.

* * * * *